US012601151B2

(12) United States Patent
Thompson

(10) Patent No.: US 12,601,151 B2
(45) Date of Patent: Apr. 14, 2026

(54) UNIVERSAL HYDRAULIC CONNECTING QUICK COUPLER SYSTEM

(71) Applicant: Caterpillar Inc., Peoria, IL (US)

(72) Inventor: Mark William Thompson, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 792 days.

(21) Appl. No.: 17/961,341

(22) Filed: Oct. 6, 2022

(65) Prior Publication Data

US 2024/0117603 A1 Apr. 11, 2024

(51) Int. Cl.
*E02F 3/36* (2006.01)
*E02F 3/96* (2006.01)
*E02F 9/22* (2006.01)

(52) U.S. Cl.
CPC ..... *E02F 9/2278* (2013.01); *E02F 3/3631* (2013.01); *E02F 3/3654* (2013.01); *E02F 3/3663* (2013.01)

(58) Field of Classification Search
CPC ..... E02F 3/3631; E02F 3/3654; E02F 3/3663; E02F 3/3609; E02F 3/3627; E02F 3/364; E02F 3/967; E02F 3/365; E02F 3/38; E02F 9/2278
See application file for complete search history.

(56) References Cited

U.S. PATENT DOCUMENTS 5,465,513 A 11/1995 Sonerud
6,163,989 A 12/2000 Kaczmarski
6,364,561 B1 * 4/2002 Droegemueller ..... E02F 3/967 403/336
6,428,265 B1 * 8/2002 Gilmore, Jr. ..... E02F 3/38 37/468
7,770,311 B2 * 8/2010 Hahnel ..... E02F 3/3609 37/444
9,945,093 B1 4/2018 Belliveau
9,970,177 B2 * 5/2018 Koestler ..... E02F 3/365
11,105,064 B2 8/2021 Smith
(Continued)

FOREIGN PATENT DOCUMENTS

EP 3699362 8/2022

OTHER PUBLICATIONS

Written Opinion and International Search Report for Int'l. Patent Appln. No.PCT/US2023/074427, mailed Dec. 20, 2023 (13 pgs).

*Primary Examiner* — Joseph M Rocca
*Assistant Examiner* — Robert E Pezzuto

(57) ABSTRACT

A quick coupler system for connecting a work tool to an arm of a work machine includes an adapter bracket with spaced apart side walls each having first and second adapter openings for receiving first and second bracket pins of a work tool bracket. The adapter bracket is disposed between bracket side walls of the work tool bracket when the adapter openings receiving the corresponding bracket pins. A coupler link having first and second coupler openings receives and engages the first and second bracket pins to connect the work tool to the arm, with the coupler link being disposed between the adapter side walls. The adapter bracket may have an adapter hydraulic interface block that is aligned with a coupler hydraulic interface block of the coupler link to form a fluid flow path for hydraulic fluid from a pressurize fluid source of the work machine to the work tool.

20 Claims, 8 Drawing Sheets

(56) References Cited

U.S. PATENT DOCUMENTS

| | | | |
|---|---|---|---|
| 11,274,413 | B2 | 3/2022 | Breu |
| 2012/0227246 | A1 | 9/2012 | Dawson |
| 2018/0135271 | A1 | 5/2018 | Gonzalez et al. |
| 2020/0283989 | A1 | 9/2020 | Schmid |

* cited by examiner

UNIVERSAL HYDRAULIC CONNECTING QUICK COUPLER SYSTEM

TECHNICAL FIELD

The present disclosure relates generally to quick couplers for work machines and, more particularly, to hydraulic connecting quick couplers configured for use with hydromechanical and non-hydromechanical work tools having varying pin diameters and pin spreads.

BACKGROUND

Hydraulic connecting quick couplers allow for work machines such as excavators, backhoes, wheel loaders and the like to be able to switch between different hydromechanical or non-hydromechanical work tools quickly and easily. During the work tool coupling process, the coupler connects the physical work tool and the work tool's hydraulic circuit, if equipped, to the work machine. Hydraulic connecting quick couplers offer improvements over previously-known standard quick couplers, such as those disclosed U.S. Pat. Nos. 11,274,413, 9,945,093, and 6,163,989, and U.S. Pat. Appl. Publ. No. 2020/0283989, that physically connect the work tool to the work machine but require hydraulic lines of the work tool to be manually connected to the work machine.

Hydraulic connecting couplers enable an operator to switch between different hydromechanical work tools within seconds without having to leave the cab of the machine. One type of previously-known hydraulic connecting quick coupler is a pin grabber style. The pin grabber couplers are capable of picking up work tools with a range of pin spreads and pin diameters. This is beneficial for machine owners having a fleet of work tools from different equipment manufactures. The pin grabber coupler allows work tools to be picked up that the work machine might not have been able to pick up previously without requiring major rework to the work tool. Despite the versatility, hydraulic connecting pin grabber quick couplers still require a new bracket to be swapped out on hydromechanical work tools. Consequently, regardless of the hydraulic connecting coupler, machine owners typically must buy and install new work tool brackets for hydromechanical work tools to be able to use a hydraulic connecting coupler.

SUMMARY OF THE DISCLOSURE

In one aspect of the present disclosure, an adapter bracket of a quick coupler system for connecting a work tool to an arm of a work machine is disclosed. The work tool may include a work tool bracket having a first bracket pin and a second bracket pin extending between a first bracket side plate and a second bracket side plate. The adapter bracket may include a first adapter side wall and a second adapter side wall spaced apart from the first adapter side wall to define an interior space that receives a coupler link of the quick coupler system when the quick coupler system connects the work tool to the arm of the work machine. Each of the first adapter side wall and the second adapter side wall may have a first adapter pin opening that receives the first bracket pin therein and a second adapter pin opening that receives the second bracket pin therein to attach the adapter bracket to the work tool with the first bracket pin disposed within the first adapter pin opening of each of the first adapter side wall and the second adapter side wall, the second bracket pin disposed within the second adapter pin opening of each of the first adapter side wall and the second adapter side wall, and the adapter bracket disposed between the first bracket side plate and the second bracket side plate.

In another aspect of the present disclosure, a quick coupler system for connecting a work tool to an arm of a work machine is disclosed. The work tool includes a work tool bracket having a first bracket pin and a second bracket pin extending between a first bracket side plate and a second bracket side plate. The quick coupler system may include a coupler link and an adapter bracket. The coupler link may include a coupler link body having a first coupler pin opening that receives the first bracket pin therein and a second coupler pin opening that receives the second bracket pin therein to attach the arm of the work machine to the work tool, and a coupler hydraulic interface block mounted to the coupler link body. The adapter bracket may include a first adapter side wall, a second adapter side wall spaced apart from the first adapter side wall to define an interior space, wherein the first adapter side wall and the second adapter side wall each have a first adapter pin opening and a second adapter pin opening formed therein, and an adapter hydraulic interface block mounted between the first adapter side wall and the second adapter side wall. The adapter bracket may be attached to the work tool bracket by receiving the first bracket pin in the first adapter pin openings and receiving the second bracket pin in the second adapter pin openings so that the adapter bracket is disposed between the first bracket side plate and the second bracket side plate of the work tool bracket. The coupler link may be attached to the work tool bracket after the adapter bracket by receiving the first bracket pin in the first coupler pin opening and receiving the second bracket pin in the second coupler pin opening so that the coupler link body is disposed within the interior space of the adapter bracket and the coupler hydraulic interface block is aligned with and engages the adapter hydraulic interface block to form a fluid flow path for a flow of hydraulic fluid from arm hydraulic hoses of the arm to work tool hydraulic hoses of the work tool that are connected to the adapter hydraulic interface block to supply pressurized hydraulic fluid to the work tool.

In a further aspect of the present disclosure, an adapter bracket of a quick coupler system for connecting a work tool to an arm of a work machine is disclosed. The work tool includes a work tool bracket having a first bracket pin and a second bracket pin extending between a first bracket side plate and a second bracket side plate. The adapter bracket may include a first adapter side wall and a second adapter side wall spaced apart from the first adapter side wall to define an interior space that receives a coupler link of the quick coupler system when the quick coupler system connects the work tool to the arm of the work machine. The first adapter side wall and the second adapter side wall may each have a first pin opening inner surface defining a first portion of a first adapter pin opening that receives the first bracket pin therein and a second pin opening inner surface defining a second adapter pin opening that receives the second bracket pin therein, the second adapter pin opening of each of the first adapter side wall and the second adapter side wall has an opening gap at a bottom edge of the corresponding one of the first adapter side wall and the second adapter side wall. The adapter bracket may further include a first pin retention bracket defining a second portion of the first adapter pin opening of the first adapter side wall, wherein the first pin retention bracket connects to the first adapter side wall proximate the first pin opening inner surface when the first bracket pin is disposed in the first portion of the first adapter pin opening to retain the first bracket pin in the first adapter pin opening of the first adapter side wall. The adapter bracket may also include a second pin retention bracket defining a second portion of the first adapter pin opening of the second adapter side wall, wherein the second pin retention bracket connects to the second adapter side wall proximate the second pin opening inner surface when the first bracket pin is disposed in the first portion of the first adapter pin opening to retain the first bracket pin in the first adapter pin opening of the second adapter side wall. The adapter bracket may be attached to the work tool with the first bracket pin disposed within the first adapter pin opening of each of the first adapter side wall and the second adapter side wall, the second bracket pin passing through the opening gap and disposed within the second adapter pin opening of each of the first adapter side wall and the second adapter side wall, and the adapter bracket disposed between the first bracket side plate and the second bracket side plate.

Additional aspects are defined by the claims of this patent.

DETAILED DESCRIPTION

Figure 1:
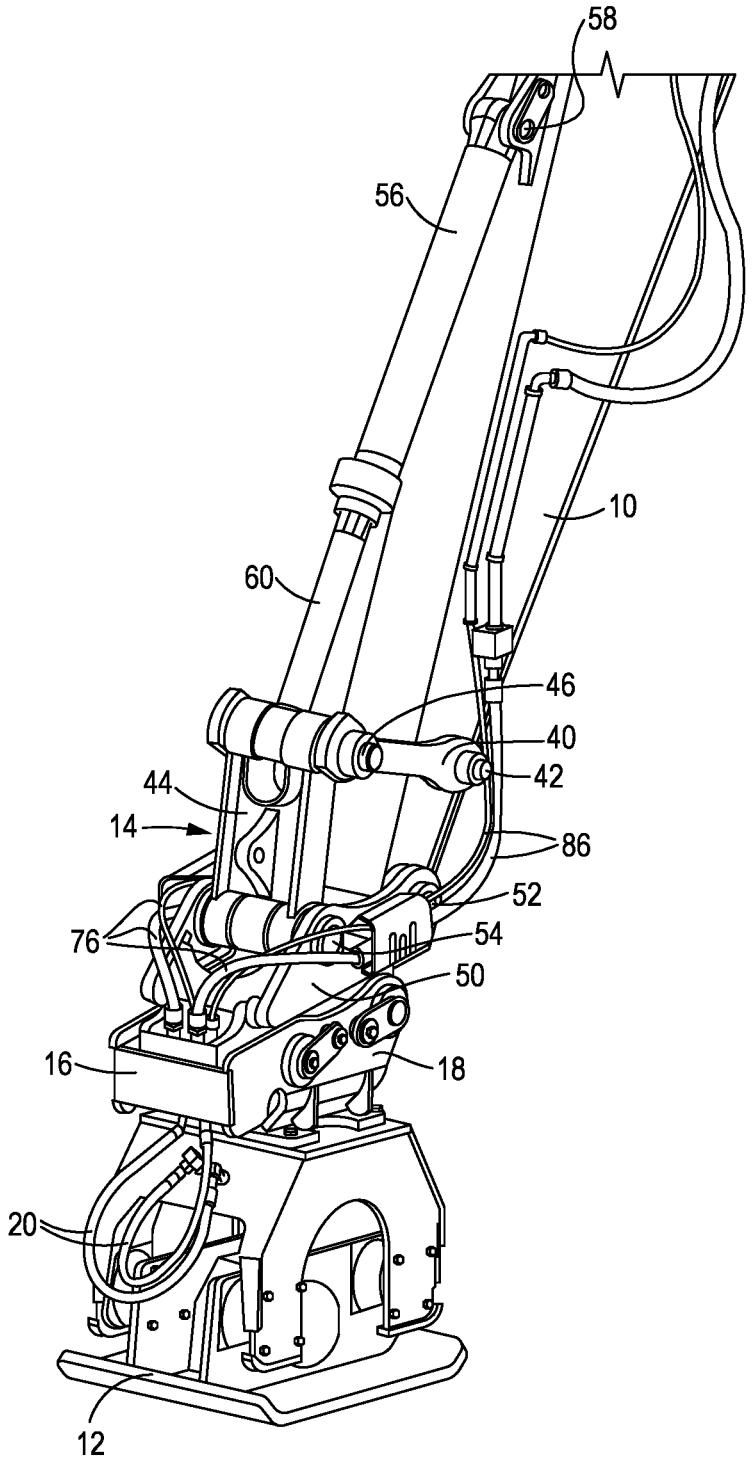
FIG. 1 is an isometric view of an arm of a work machine having a quick coupler assembly connected to a work tool and an adapter bracket in accordance with the present disclosure.

Adapter brackets in accordance with the present disclosure eliminate the necessity of buying and installing new work tool mounting brackets for existing hydromechanical work tools. The adapter bracket allows for installation of the adapter bracket to existing hydromechanical work tool brackets and to use the adapter bracket with a hydraulic connecting coupler. FIG. 1 illustrates an arm 10 of a work machine, such as an excavator, a backhoe, a wheel loader and the like, having a hydromechanical work tool 12 coupled thereto by a quick coupler system that includes a quick coupler assembly 14 and an adapter bracket 16 in accordance with the present disclosure. The work tool 12 as illustrated is a vibrator plate compactor that may be powered to vibrate by hydraulic fluid provided from the work machine as discussed further below. The work tool 12 has a work tool bracket 18 mounted thereon that is engaged by the coupler assembly 14 and the adapter bracket 16 to connect the work tool 12 to the arm 10.

Figure 2:
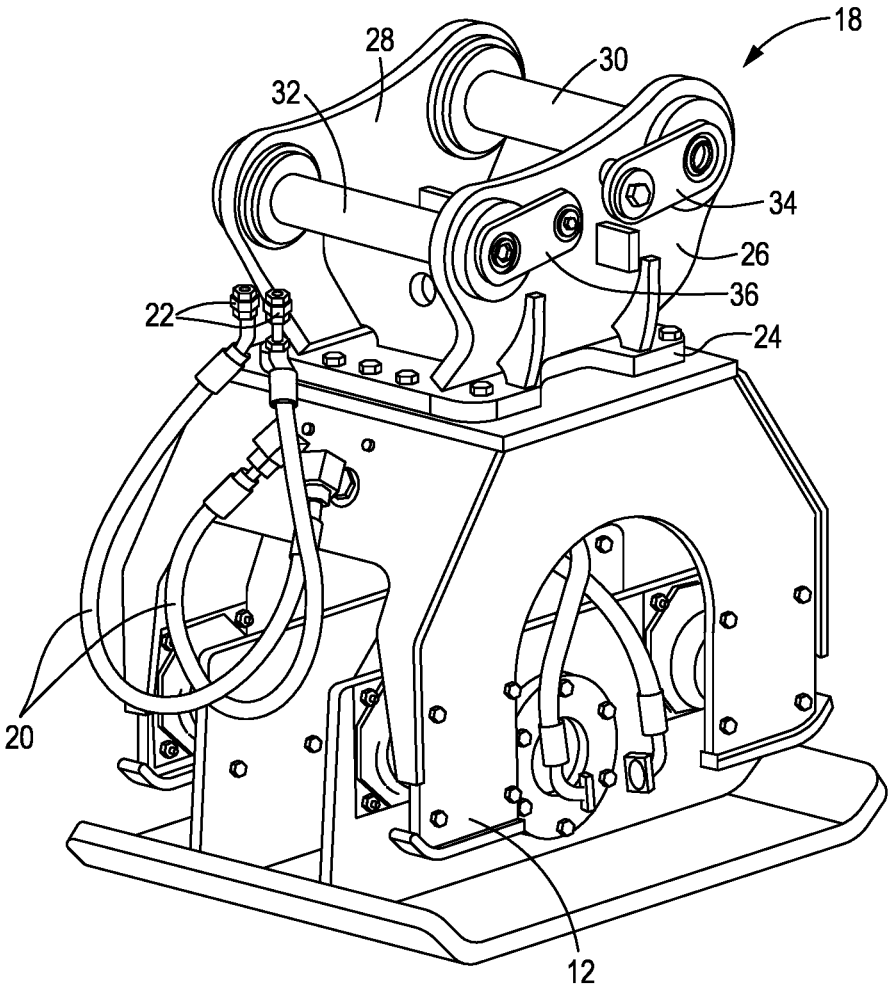
FIG. 2 is an isometric view of the work tool and the work tool bracket of FIG. 1.

The work tool 12 and the work tool bracket 18 are illustrated in greater detail in FIG. 2. The work tool 12 includes work tool hydraulic hoses 20 with tool hose connectors 22 that will be attached to the adapter bracket 16 to receive the hydraulic fluid from the work machine. The exemplary work tool bracket 18 may include a bracket base plate 24 that may be detachably or permanently mounted to the body of the work tool 12 by appropriate fastening mechanisms such as bolts, clamps, welds and the like. A first bracket side plate 26 and a second bracket side plate 28 may extend from opposite lateral edges of the bracket base plate 24 and have a first bracket pin 30 and a second bracket pin 32 extending therebetween. The bracket pins 30, 32 may have pin connector plates 34, 36 mounted on ends corresponding to the first bracket side plate 26, with the pin connector plates 34, 36 being bolted to the first bracket side plate 26 to secure the bracket pins 30 to the work tool bracket 18.

The vibrator plate compactor is exemplary of hydromechanical work tools that may be connected to the arm 10 for the performance of useful work. Other hydromechanical work tools such as augers, bale grabs, brooms, bush cutters, cold planers, flail mowers, grapplers, hammers, mulchers, pulverizers, rakes, saws, shears, stump grinders, tillers, trenchers, winches and the like may be connected to the arm 10 in a similar manner as disclosed herein. Similarly, other implements that do not require hydraulic power, such as bale spears, buckets, forks, rippers, snow plows, other material handling implements and the like, may be connected to the arm 10 in a similar manner without the necessity of making the hydraulic connections provide by the coupler assembly 14 and the adapter bracket 16.

Returning to FIG. 1, the coupler assembly 14 may include an idler link 40 pivotally connected at one end to the arm 10 at a pin joint 42, and a power link 44 pivotally connected an opposite end of the idler link 40 at a pin joint 46. A coupler link 50 may be pivotally coupled to the arm 10 at a pin joint 52 and to the power link 44 opposite the idler link 40 by a pin joint 54 such that the arm 10, the idler link 40, the power link 44 and the coupler link 50 form a four-bar mechanism. An actuator such as a hydraulic cylinder 56 may be pivotally connected to the arm 10 at a pin joint 58 and to the coupler assembly 14 at the pin joint 46 so that extending and retracting a piston rod 60 of the hydraulic cylinder 56 rotates the coupler link 50 about the pin joint 52.

Figure 3:
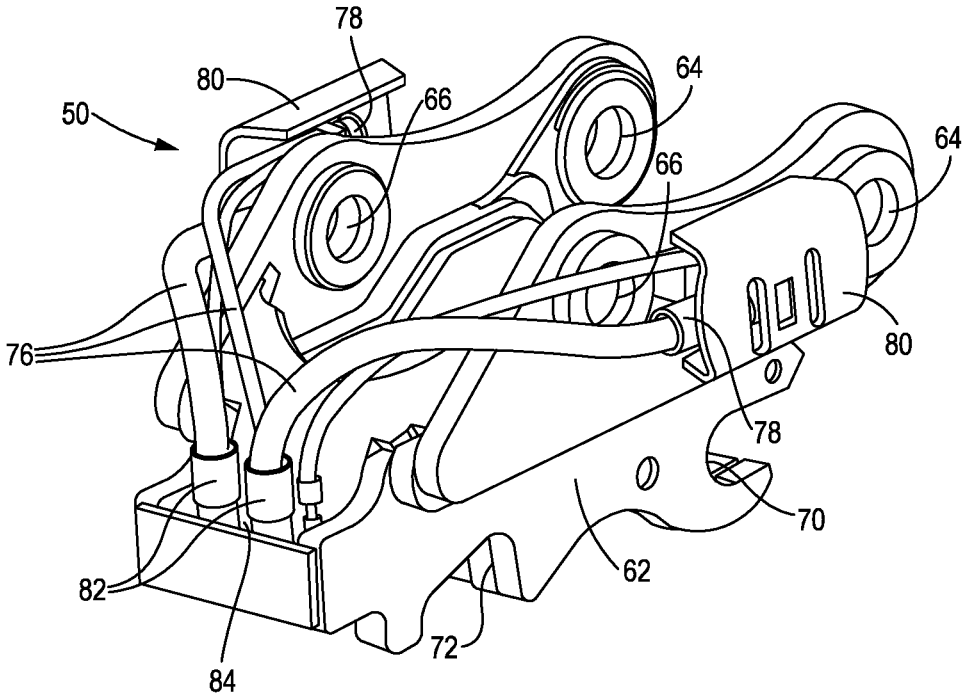
FIG. 3 is a top isometric view of a coupler link of the coupler assembly of FIG. 1.
Figure 4:
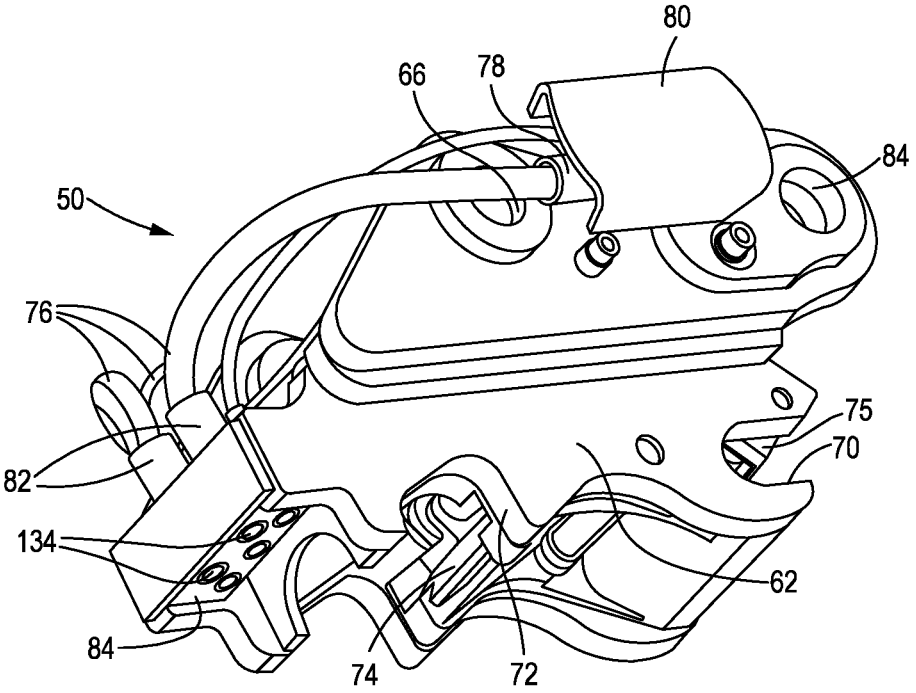
FIG. 4 is a bottom isometric view of the coupler link of FIG. 3.

Referring to FIGS. 3 and 4, the coupler link 50 has a coupler link body 62 with pin joint openings 64, 66 for receiving pins forming the pin joints 52, 54, respectively. The coupler link 50 is configured to capture the bracket pins 30, 32 of the work tool bracket 18 to couple the work tool 12 to the arm 10. The coupler link body 62 includes a first coupler pin opening 70 configured to receive the first bracket pin 30 therein, and a second coupler pin opening 72 configured to receive the second bracket pin 32 therein. The coupler link 50 may further include a coupler lock member 74 (FIG. 4) and a corresponding coupler lock mechanism (not shown) within the coupler link body 62. Such coupler lock mechanisms are known in the art, and operate to extend the coupler lock member 74 over the second coupler pin opening 72 when the second bracket pin 32 is disposed therein to engage and retain the second bracket pin 32 as the work machine operates with the work tool 12 attached to the arm 10, and to retract the coupler lock member 74 to the illustrated position when the work tool 12 is detached from the arm 10. If necessary, the coupler link 50 may include a secondary coupler lock member 75 at the first coupler pin opening 70 that may extend over the first coupler pin opening 70 at the same time as the coupler lock member 74 to engage and retain the first bracket pin 30 in the first coupler pin opening 70. The coupler pin openings 70, 72 may be sized to receive bracket pins 30, 32 having a range of diameters. Also, the coupler pin openings 70, 72 may be positioned relative to each other to accommodate work tool brackets 18 having the bracket pins 30, 32 spaced from each other by different distances. Configured in this way, the coupler link 50 may accommodate connecting to a variety of work tool 12/work tool bracket 18 combinations that may be utilized by the work machine without the necessity of changing out the coupler link 50 or coupler assembly 14 to one matching the configuration of other work tools 12.

The coupler link 50 may be configured to form a portion of the fluid connection between the work machine and the hydromechanical work tool 12. A plurality of coupler hydraulic hoses 76 may be mounted on the coupler link body 62 with first ends having first coupler hose connectors 78 covered by coupler shields 80 that prevent damage during operation. Second ends of the coupler hydraulic hoses may have second coupler hose connectors 82 that may be attached to corresponding connectors (not shown) of a coupler hydraulic interface block 84 that may also be mounted on the coupler link body 62. Referring back to FIG. 1, the arm 10 may have arm hydraulic hoses 86 mounted thereon that are connected to a source (not shown) of pressurized hydraulic fluid of the work machine. Ends of the arm hydraulic hoses 86 proximate the coupler assembly 14 may be connected to the first coupler hose connectors 78 when the coupler assembly 14 is assembled on the arm 10 to form part of the hydraulic fluid flow path to the work tool 12 as discussed further hereinafter.

Figure 5:
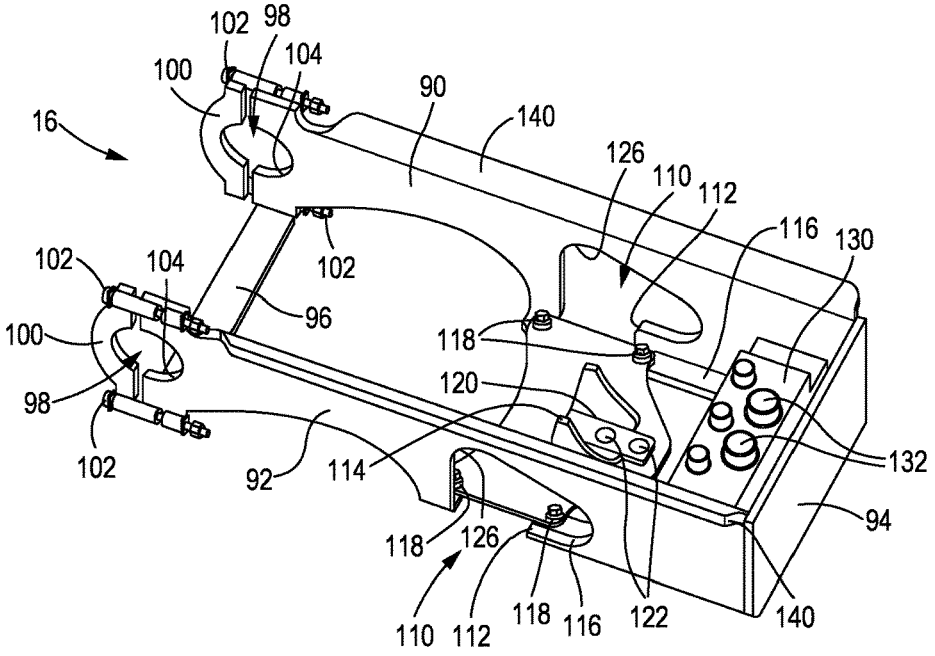
FIG. 5 is a top isometric view of the adapter bracket of FIG. 1.

As shown in FIG. 1, the adapter bracket 16 may provide an interface between the coupler assembly 14 and the work tool bracket 18 for connection and fluid flow to the work tool 12. The adapter bracket 16 is illustrated in greater detail in FIGS. 5 and 6. In the illustrated embodiment, the adapter bracket 16 is configured to be received between the bracket side plates 26, 28 of the work tool bracket 18 and receive the bracket pins 30, 32, and to receive the coupler link 50 therein for its engagement of the bracket pins 30, 32. Referring to FIG. 5, the adapter bracket 16 may include a first adapter side wall 90 and a second adapter side wall 92 that are spaced apart and connected to by a guard plate 94 and a connector plate 96 to define an interior space into which the coupler link 50 is received. The adapter side walls 90, 92 are configured to be connected to the bracket pins 30, 32 without the necessity of removing the bracket pins 30, 32. First adapter pin openings 98 correspond to and receive the first bracket pin 30 therein. The adapter side walls 90, 92 may define first portions of the first adapter pin openings 98, and pin retention brackets 100 attached to the adapter side walls 90, 92 may define the remaining portions of the adapter pin openings 98. The pin retention brackets 100 may be connected to the adapter side walls 90, 92 by corresponding pin retention bracket bolts 102 that may have an axial length to accommodate clamping the pin retention brackets 100 around first bracket pins 30 having different diameters.

Figure 6:
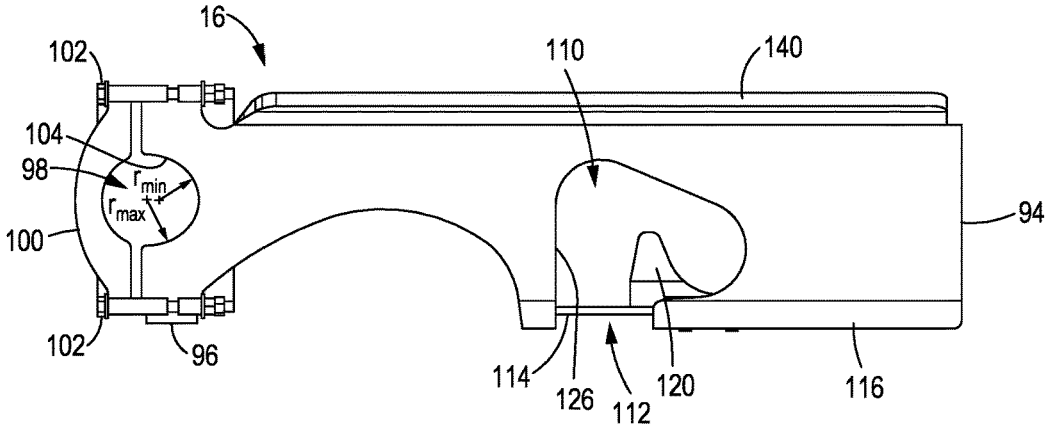
FIG. 6 is a side view of the adapter bracket of FIG. 1.

The first adapter pin openings 98 are further configured to ensure tight engagement of the adapter bracket 16 to first bracket pins 30 of different diameters. Referring to FIG. 6, the first portion of the first adapter pin openings 98 is defined by the adapter side walls 90, 92 may have a first pin opening inner surface 104 have a varying radius with portions corresponding at least to the smallest and largest diameters of the first bracket pins 30 to be received in the first adapter pin openings 98. Consequently, an inward portion of the first pin opening inner surface 104 may have a minimum radius $r_{MIN}$ corresponding to the minimum diameter first bracket pin 30, and the inward portion may transition to an outward portion of the first pin opening inner surface 104 having a maximum radius $r_{MAX}$ corresponding to the maximum diameter first bracket pin 30. The portions of the first adapter pin opening 98 defined by the pin retention brackets 100 may have the maximum radius $r_{MAX}$.

Figure 7:
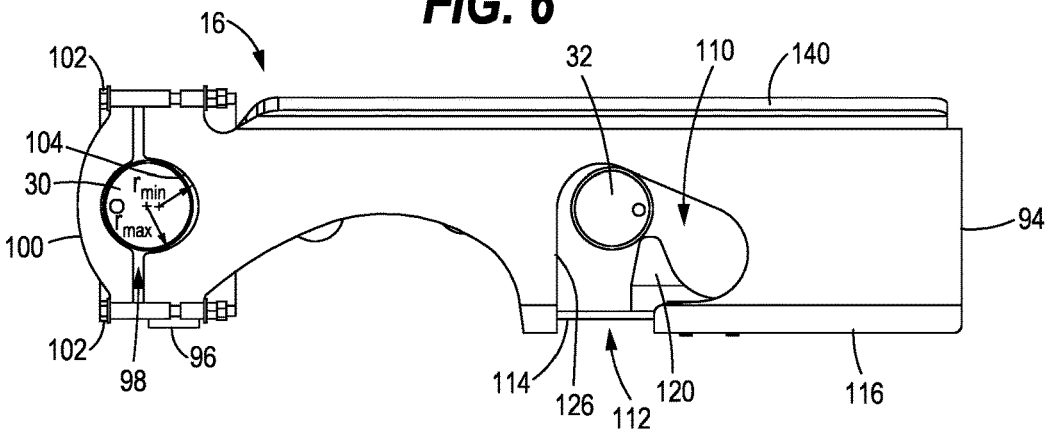
FIG. 7 is the side view of the adapter bracket of FIG. 6 with bracket pins of the work tool bracket disposed within adapter pin openings of the adapter bracket.

When a first bracket pin 30 having the minimum radius $r_{MIN}$ is received in the first adapter pin openings 98, the inward portions of the first pin opening inner surfaces 104 may engage the outer surface of the first bracket pin 30. When a first bracket pin 30 having the maximum radius $r_{MAX}$ is received, the outward portions of the first pin opening inner surfaces 104 may engage the outer surface of the first bracket pin 30 as shown in FIG. 7. First bracket pins 30 sized between the minimum outer diameter and the maximum outer diameter will be engaged by the first pin opening inner surfaces 104 at upper and lower transition portions between the inward portions and the outward portions. When the bolts 102 are tightened and the pin retention brackets 100 clamp the first bracket pin 30 in the first adapter pin openings 98, there will be at least three points of contact with the first bracket pin 30 to ensure substantially no relative movement between the first bracket pin 30 and the adapter side walls 90, 92. Those skilled in the art will understand that the first pin opening inner surfaces 104 may be configured to transition between an additional intermediate radius or radii between the minimum radius $r_{MIN}$ and the maximum radius $r_{MAX}$ if desired to include portions corresponding to other specific diameters of first bracket pins 30 expected to be received in the first adapter pin openings 98. Additionally, the first coupler pin opening 70 may have the same or a similar profile as the first adapter pin openings 98 to ensure consistent alignment and engagement between the coupler link 50 and adapter bracket 16.

Returning to FIG. 5, the adapter side walls 90, 92 further define second adapter pin openings 110 that will receive the second bracket pin 32 when the adapter bracket 16 is installed on the work tool bracket 18. The second adapter pin openings 110 may have a shape that is generally similar to the shape of the second coupler pin opening 72 to accept a similar variety of second bracket pins 32. Moreover, the adapter pin openings 98, 110 may have similar relative positions as the coupler pin openings 70, 72 to accommodate different configurations of work tool brackets 18. The second adapter pin openings 110 in the illustrated embodiment have opening gaps 112 at bottom edges of the adapter side walls 90, 92 that are wide enough to receive second bracket pins 32 of varying diameters. With this configuration, the adapter bracket 16 may be installed on the work tool bracket 18 by first inserting the first bracket pin 30 into the first portions of the first adapter pin openings 98 formed by the adapter side walls 90, 92. The adapter bracket 16 may then be rotated toward the second bracket pin 32 until the second bracket pin 32 is received through the opening gaps 112 and into the second adapter pin openings 110. With the bracket pins 30, 32 disposed in the respective adapter pin openings 98, 110, the pin retention brackets 100 may be tightened down securely on the first bracket pin 30.

Figure 8:
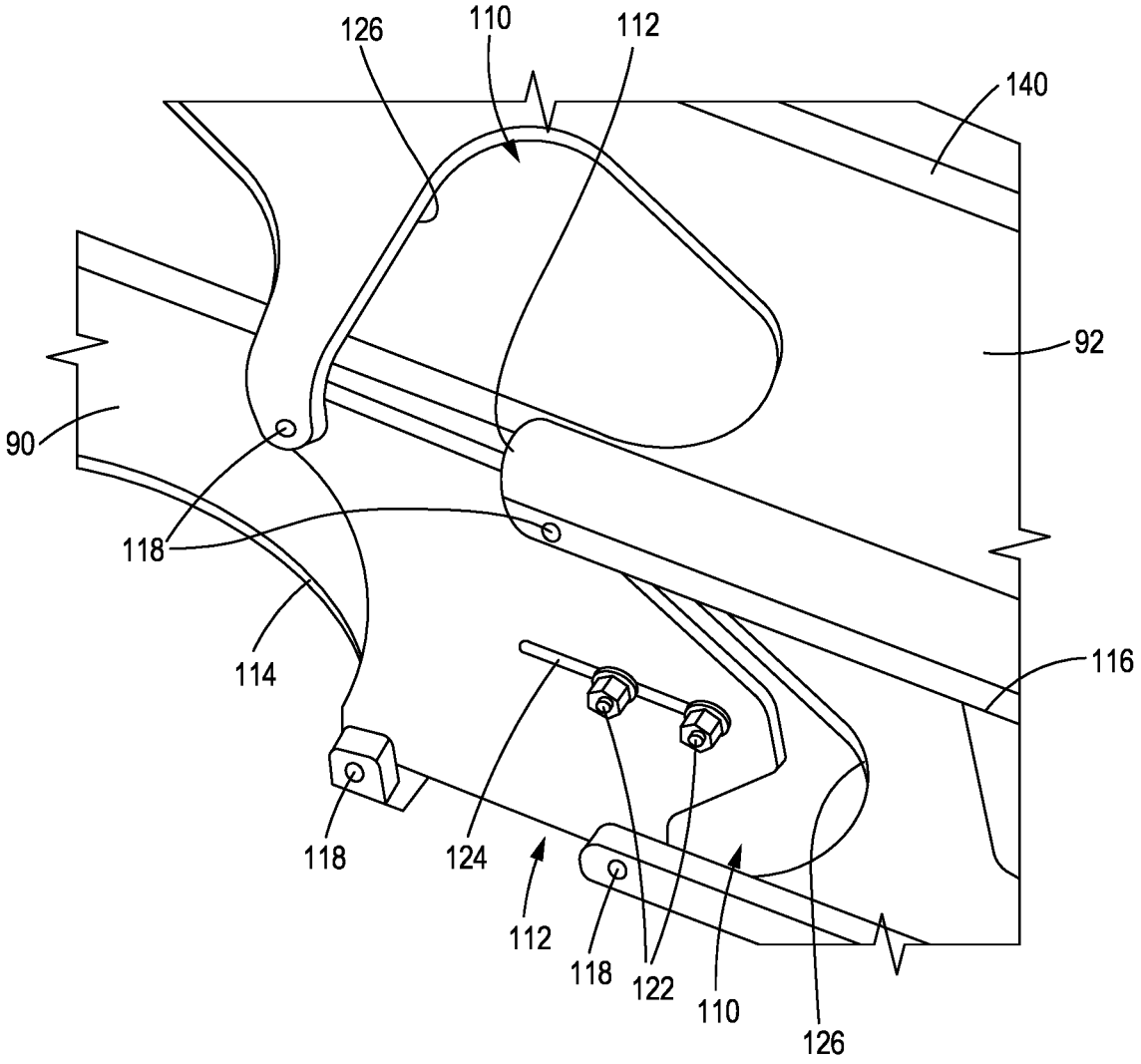
FIG. 8 is a bottom isometric view of a portion of the adapter bracket of FIG. 1.

With this arrangement, the adapter bracket 16 may remain in place on the work tool bracket 18 due to the clamping force on the first bracket pin 30 preventing rotation of the adapter bracket 16 away from the second bracket pin 32. Additionally, the adapter bracket 16 will be trapped between the work tool bracket 18 and the coupler link 50 when the coupler assembly 14 connects to the bracket pins 30, 32 as discussed further below. However, to prevent movement of the adapter bracket 16 if necessary, a gap cover plate 114 may be attached at the bottom edges of the adapter side walls 90, 92 and span the opening gaps 112. The bottom edges of the adapter side walls 90, 92 may be bent inward to form lower shoulders 116 to which the gap cover plate 114 may be removably attached with bolts 118 after the second bracket pin 32 is disposed within the second adapter pin openings 110. The gap cover plate 114 may only loosely retain the second bracket pin 32 within the second adapter pin opening 110 as seen in FIG. 7. For tighter engagement, a pin retention finger 120 may be slidably mounted to the gap cover plate 114 by bolts 122 that pass through a slot 124 (FIG. 8) in the gap cover plate 114. After the gap cover plate 114 is attached to the adapter side walls 90, 92, the pin retention finger 120 may be slid into the position shown in FIG. 7 to clamp the second bracket pin 32 against second pin opening inner surfaces 126 of the second adapter pin openings 110, and the bolts 122 may be tightened to substantially prevent movement of the adapter bracket 16 relative to the second bracket pin 32.

The adapter bracket 16 may also form a portion of the fluid connection between the work machine and the work tool 12. As shown in FIG. 5, the adapter bracket 16 may have an adapter hydraulic interface block 130 mounted thereto proximate the guard plate 94. The adapter hydraulic interface block 130 may be positioned to align with the coupler hydraulic interface block 84 when the coupler link 50 is attached to the bracket pins 30, 32. The adapter hydraulic interface block 130 may include upwardly extending male connection elements 132 that align with and are received by female connection elements 134 (FIG. 4) at the bottom of the coupler hydraulic interface block 84. When the coupler link 50 is connected, the hydraulic interface blocks 84, 130 form a fluid connection that permits fluid flow from the arm hydraulic hoses 86 to the work tool 12.

Figure 9:
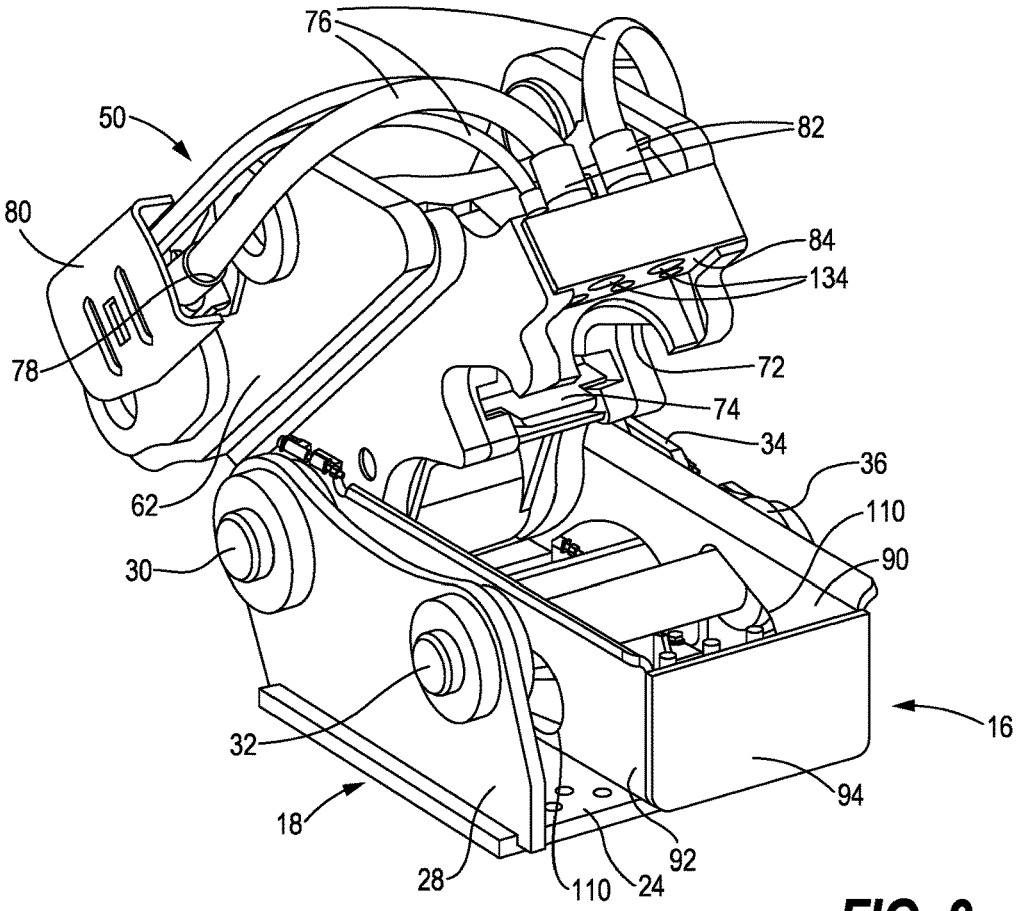
FIG. 9 is an isometric view of the work tool bracket, the adapter bracket and the coupler link of FIG. 1 with the coupler link partially attached to bracket pins of the work tool bracket.
Figure 10:
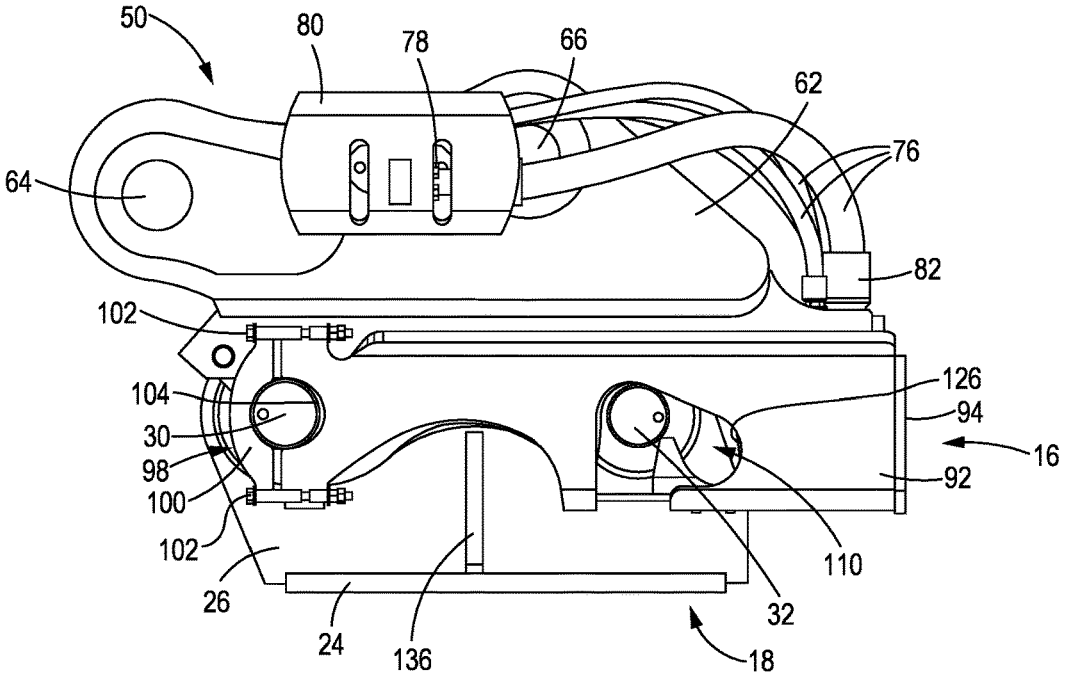
FIG. 10 is a side view of the work tool bracket, the adapter bracket and the coupler link of FIG. 1 with the coupler link fully attached to bracket pins of the work tool bracket and with the second bracket side plate removed to reveal the adapter bracket.

FIG. 9 illustrates the adapter bracket 16 attached to the work tool bracket 18 and the coupler link 50 in the process of being coupled to the bracket pins 30, 32. The work tool 12 and the work tool hydraulic hoses 20 are not shown, but it will be understood that the work tool hydraulic hoses 20 will have been connected to corresponding connection elements on the bottom of the adapter hydraulic interface block 130 when the adapter bracket 16 is mounted to the bracket pins 30, 32 between the bracket side plates 26, 28. As shown in FIG. 9, coupling of the work tool 12 to the arm 10 begins with inserting the end of the coupler link 50 with the first coupler pin opening 70 into the interior space between the adapter side walls 90, 92 until the first coupler pin opening 70 receives the first bracket pin 30. Upper edges of the adapter side walls 90, 92 may be bent outward to form rounded adapter wall shoulders 140 that may assist in guiding the coupler link 50 into the interior space of the adapter bracket 16. After the first bracket pin 30 is received by the first coupler pin opening 70, the hydraulic cylinder 56 may be actuated to extend the piston rod 60 and rotate the coupler link 50 toward the second bracket pin 32 until the second bracket pin 32 is received by the second coupler pin opening 72 (FIG. 10 where the second bracket side plate 28 is removed to reveal the adapter bracket 16) and the male connection elements 132 of the adapter hydraulic interface block 130 are received by the female connection elements 134 of the coupler hydraulic interface block 84. As discussed above, the coupler pin openings 70, 72 and the adapter pin openings 98, 110, respectively, may have the same or similar profiles and spacing to ensure proper alignment and engagement between the hydraulic interface blocks 84, 130.

The work tool bracket 18 may have internal elements between the bracket side plates 26, 28 such as gussets 136, torque tubes or the like that must be accommodated by the adapter side walls 90, 92. Consequently, the adapter side walls 90, 92 may have a curved profile as shown, slots or other cutouts as necessary to avoid contacting the internal elements when the adapter bracket 16 is mounted to the work tool bracket 18. At this point, the coupler lock mechanism may be actuated to extend the coupler lock member 74 to lock the second bracket pin 32 in the second coupler pin opening 72.

With the adapter bracket 16 mounted and the coupler link 50 coupled to the bracket pins 30, 32, a fluid connection is established from the arm hydraulic hoses 86 through the hydraulic interface blocks 84, 130 and the work tool hydraulic hoses 20 to the hydraulic elements of the work tool 12 for operation of the work tool 12. With the fluid connection established, the operator does not have to exit the cab to complete the connection. Instead, the operator can immediately begin operating the work machine and the work tool 12.

Figure 11:
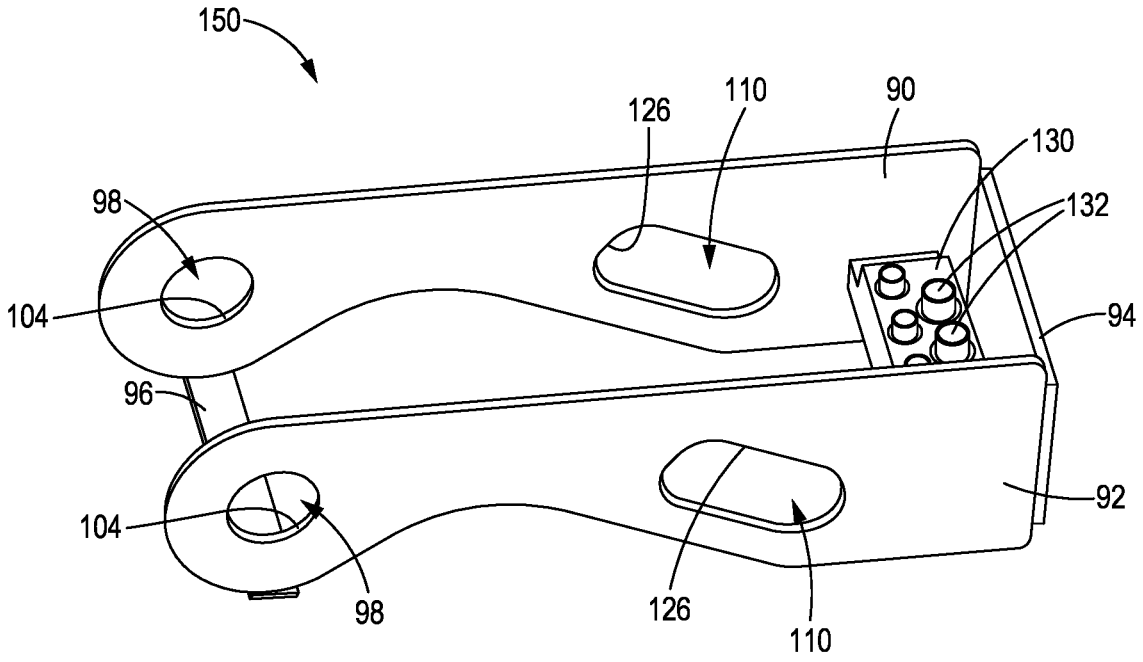
FIG. 11 is an isometric view of an alternate embodiment of an adapter bracket in accordance with the present disclosure.
Figure 12:
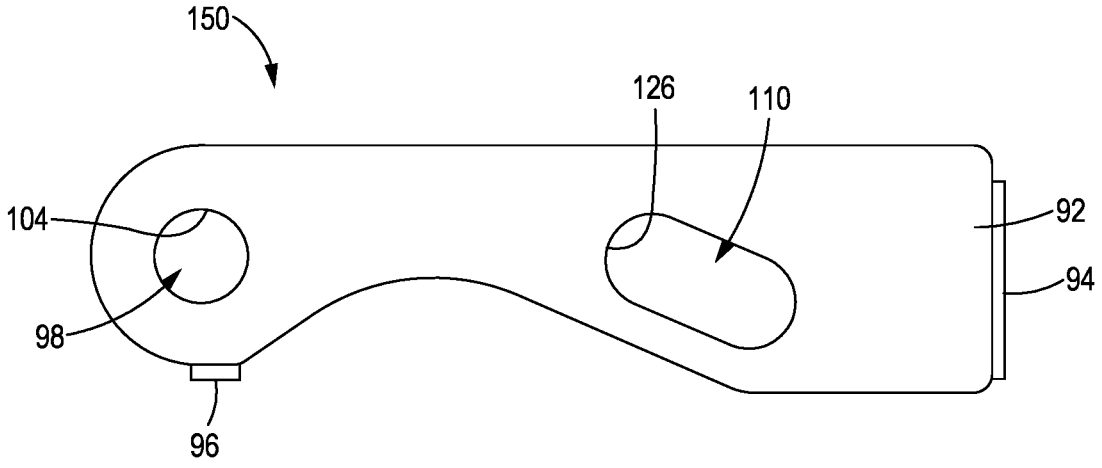
FIG. 12 is a side view of the adapter bracket of FIG. 11.

FIGS. 11 and 12 illustrate and alternative embodiment of an adapter bracket 150 where similar elements as the adapter bracket 16 are identified with the same reference numerals. In this embodiments, the first adapter pin openings 98 and the second adapter pin openings 110 are closed such that the bracket pins 30, 32 must be removed from the work tool bracket 18 so that the adapter bracket 150 can be installed. To make the adapter bracket useful with first bracket pins 32 having different diameters, the first adapter pin openings 98 have an inner diameter that is at least equal to the diameter of the largest first bracket pin 30 that will be inserted through the first adapter pin openings 98. When smaller diameter first bracket pins 30 are used, opening inserts or collars (not shown) having inner diameters corresponding to the diameter of the first bracket pins 30 may be installed within the first adapter pin openings 98 and around the first bracket pins 30 to form tight fit that substantially prevents movement of the first bracket pins 30 relative to the adapter bracket 150 after installation.

Figure 13:
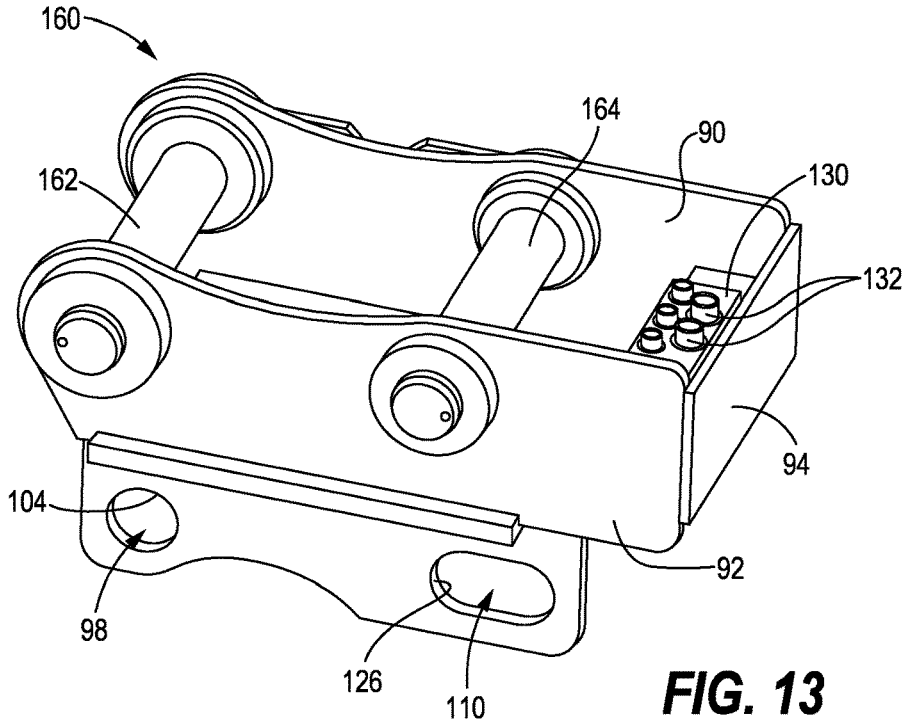
FIG. 13 is an isometric view of a further alternate embodiment of an adapter bracket in accordance with the present disclosure.
Figure 14:
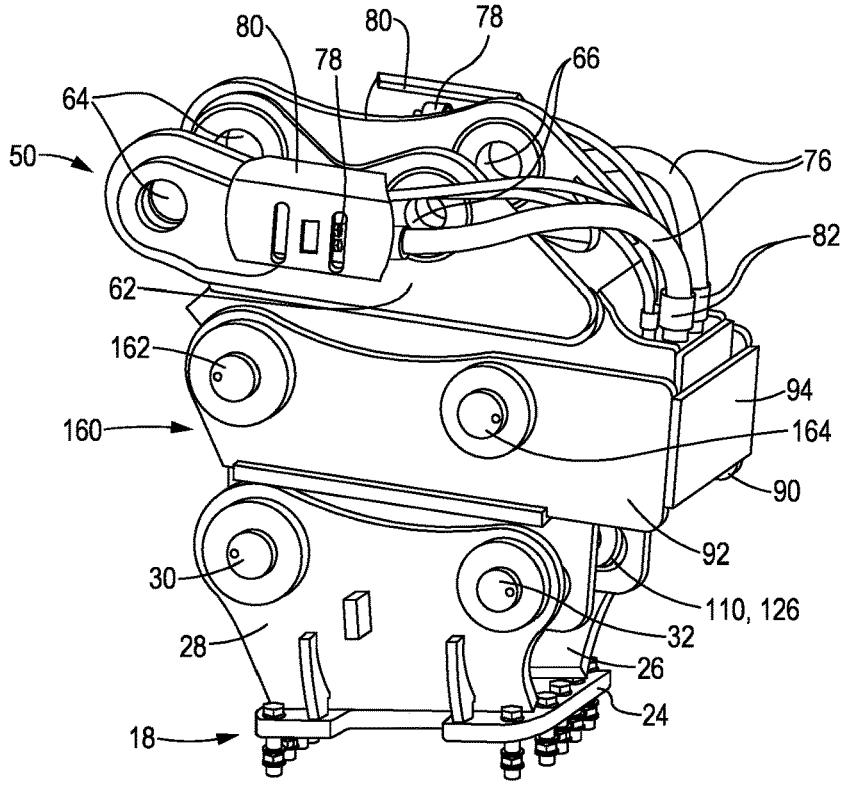
FIG. 14 is a side view of the adapter bracket of FIG. 13 mounted between the work tool bracket and the coupler link of FIG. 1.

FIGS. 13 and 14 illustrate a further alternative embodiment of an adapter bracket 160 where similar elements as the adapter bracket 16 are identified with the same reference numerals. The adapter bracket 160 has a lower portion having adapter pin openings 98, 110 that may be similar to the adapter pin openings 98, 110 of the adapter bracket 150 as shown that require the bracket pins 30, 32 to be removed to attach the adapter bracket 160 to the work tool bracket 18. Alternatively, the adapter pin openings 98, 110 of the adapter bracket 160 may be similar to the adapter pin openings 98, 110 of the adapter bracket 16 that allow the adapter bracket 160 to be attached without removing the bracket pins 30, 32. An upper portion of the adapter bracket 160 may be configured similar to the work tool bracket 18 with adapter pins 162, 164 extending between the adapter side walls 90, 92.

With this configuration, the adapter bracket 160 is mounted to the work tool bracket 18 in a similar manner as the adapter brackets 16, 150 with the adapter pin openings 98, 110 receiving the bracket pins 30, 32 as shown in FIG. 14. In contrast, however, the coupler link 50 engages the adapter pins 162, 164 instead of the bracket pins 30, 32 to attach the work tool 12 and the adapter 160 to the arm 10.

INDUSTRIAL APPLICABILITY

The adapter brackets 16, 150, 160 in accordance with the present disclosure are usable with an assortment of hydromechanical and non-hydromechanical work tools 12 to provide machine owners with flexibility in utilizing a variety of work tools 12 with a given work machine. The machine owner does not have to buy a separate adapter bracket 16, 150, 160 for every work tool 12 in its fleet. For example, a machine owner having eight hydromechanical work tools 12 in its fleet does not have to purchase a separate adapter bracket 16, 150, 160 to match the work tool brackets 18 of each work tool 12. The adapter pin openings 98, 110 of the adapter brackets 16, 150, 160 accommodate different pin diameters and pin spreads, and therefore can be used with a variety of work tool bracket 18. Consequently, the machine owner may be able to purchase just a few adapter brackets 16, 150, 160 and switch the adapter brackets 16, 150, 160 between the work tools 12 to the work tools 12 required for a particular project.

The adapter brackets 16, 150, 160 allow an operator to quickly switch from one work tool 12 to another work tool 12 and begin performing work without leaving the cab of the work machine. The hydraulic connections between the work tool 12 and the adapter bracket 16, 150, 160 can be made at the time the adapter bracket 16, 150, 160 is installed on the work tool 12. When the work tool 12 is coupled to the work machine by the coupling assembly 14, the fluid connection for providing hydraulic fluid to the work tool 12 is completed when the coupler link 50 engages the bracket pins 30, 32 and the hydraulic interface blocks 84, 130 connect to establish the fluid connection to the work tool 12. With the connection established, the operator can begin work as soon as the work tool 12 is connected to the arm 10 of the work machine.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. An adapter bracket of a quick coupler system for connecting a work tool to an arm of a work machine, wherein the work tool includes a work tool bracket having a first bracket pin and a second bracket pin extending between a first bracket side plate and a second bracket side plate, the adapter bracket comprising:

a first adapter side wall; and a second adapter side wall spaced apart from the first adapter side wall to define an interior space that receives a coupler link of the quick coupler system when the quick coupler system connects the work tool to the arm of the work machine, wherein each of the first adapter side wall and the second adapter side wall has a first adapter pin opening that receives the first bracket pin therein and a second adapter pin opening that receives the second bracket pin therein to attach the adapter bracket to the work tool with the first bracket pin disposed within the first adapter pin opening of each of the first adapter side wall and the second adapter side wall, the second bracket pin disposed within the second adapter pin opening of each of the first adapter side wall and the second adapter side wall, and the adapter bracket disposed between the first bracket side plate and the second bracket side plate, wherein the first adapter side wall and the second adapter side wall are connected by a connector plate extending between the first adapter side wall and the second adapter side wall.

2. The adapter bracket of claim 1, wherein each of the first adapter side wall and the second adapter side wall comprises a pin opening inner surface defining a first portion of the first adapter pin opening, the adapter bracket comprising:

a first pin retention bracket defining a second portion of the first adapter pin opening of the first adapter side wall, wherein the first pin retention bracket connects to the first adapter side wall proximate the pin opening inner surface when the first bracket pin is disposed in the first portion to retain the first bracket pin in the first adapter pin opening of the first adapter side wall; and a second pin retention bracket defining a second portion of the first adapter pin opening of the second adapter side wall, wherein the second pin retention bracket connects to the second adapter side wall proximate the pin opening inner surface when the first bracket pin is disposed in the first portion to retain the first bracket pin in the first adapter pin opening of the second adapter side wall.

3. The adapter bracket of claim 2, wherein the pin opening inner surface of each of the first adapter side wall and the second adapter side wall comprises:

an inward portion having a first radius; and an outward portion having a second radius that is greater than the first radius.

4. The adapter bracket of claim 1, wherein the first adapter pin opening of each of the first adapter side wall and the second adapter side wall has an inner diameter that is greater than or equal to a maximum diameter of the first bracket pin, wherein, when a pin diameter of the first bracket pin is less than the maximum diameter of the first bracket pin, the adapter bracket comprises:

a first collar disposed on the first bracket pin and received by the first adapter pin opening of the first adapter side wall, wherein the first collar engages the first bracket pin and a first pin opening inner surface of the first adapter side wall to prevent movement of the first adapter side wall relative to the first bracket pin in a radial direction; and a second collar disposed on the first bracket pin and received by the first adapter pin opening of the second adapter side wall, wherein the second collar engages the first bracket pin and a second pin opening inner surface of the second adapter side wall to prevent movement of the second adapter side wall relative to the first bracket pin in the radial direction.

5. The adapter bracket of claim 1, wherein the second adapter pin opening of each of the first adapter side wall and the second adapter side wall has an opening gap at a bottom edge of the corresponding one of the first adapter side wall and the second adapter side wall, wherein the opening gap is wide enough for the second bracket pin to pass therethrough and into the second adapter pin opening.

6. The adapter bracket of claim 5, comprising a gap cover plate removably attached to the bottom edge of the first adapter side wall and the bottom edge of the second adapter side wall and extending across the opening gap of each of the first adapter side wall and the second adapter side wall to retain the second bracket pin within the second adapter pin opening of each of the first adapter side wall and the second adapter side wall.

7. The adapter bracket of claim 6, comprising a pin retention finger slidably mounted to the gap cover plate and slidable between a disengaged position wherein the pin retention finger is disengaged from the second bracket pin and an engaged position wherein the pin retention finger engages the second bracket pin to hold the second bracket pin against an inner surface of the second adapter pin opening of each of the first adapter side wall and the second adapter side wall to prevent movement of the first adapter side wall and the second adapter side wall relative to the second bracket pin in a radial direction.

8. The adapter bracket of claim 1, comprising an adapter hydraulic interface block mounted between the first adapter side wall and the second adapter side wall and positioned to align with a coupler hydraulic interface block of the coupler link so that the adapter hydraulic interface block and the coupler hydraulic interface block engage to form a fluid flow path for a flow of hydraulic fluid from arm hydraulic hoses supplying pressurized hydraulic fluid to work tool hydraulic hoses connected to the adapter hydraulic interface block.

9. The adapter bracket of claim 8, wherein the adapter hydraulic interface block comprises male connection elements, wherein the coupler hydraulic interface block comprises female connection elements, and wherein the male connection elements are received by the female connection elements when the coupler link is connected to the first bracket pin and the second bracket pin to form the fluid flow path.

10. The adapter bracket of claim 1, comprising:

a first adapter pin extending between the first adapter side wall and the second adapter side wall; and a second adapter pin extending between the first adapter side wall and the second adapter side wall, wherein the first adapter pin and the second adapter pin are engaged by the coupler link to connect the work tool to the arm of the work machine.

11. A quick coupler system for connecting a work tool to an arm of a work machine, wherein the work tool includes a work tool bracket having a first bracket pin and a second bracket pin extending between a first bracket side plate and a second bracket side plate, the quick coupler system comprising:

a coupler link comprising:

a coupler link body having a first coupler pin opening that receives the first bracket pin therein and a second coupler pin opening that receives the second bracket pin therein to attach the arm of the work machine to the work tool, and a coupler hydraulic interface block mounted to the coupler link body; and an adapter bracket comprising:

a first adapter side wall, a second adapter side wall spaced apart from the first adapter side wall to define an interior space, wherein the first adapter side wall and the second adapter side wall each have a first adapter pin opening and a second adapter pin opening formed therein, and an adapter hydraulic interface block mounted between the first adapter side wall and the second adapter side wall, wherein the adapter bracket is attached to the work tool bracket by receiving the first bracket pin in the first adapter pin openings and receiving the second bracket pin in the second adapter pin openings so that the adapter bracket is disposed between the first bracket side plate and the second bracket side plate of the work tool bracket, and wherein the coupler link is attached to the work tool bracket after the adapter bracket by receiving the first bracket pin in the first coupler pin opening and receiving the second bracket pin in the second coupler pin opening so that the coupler link body is disposed within the interior space of the adapter bracket and the coupler hydraulic interface block is aligned with and engages the adapter hydraulic interface block to form a fluid flow path for a flow of hydraulic fluid from arm hydraulic hoses of the arm to work tool hydraulic hoses of the work tool that are connected to the adapter hydraulic interface block to supply pressurized hydraulic fluid to the work tool.

12. The quick coupler system of claim 11, wherein the coupler hydraulic interface block comprises female connection elements, wherein the adapter hydraulic interface block comprises male connection elements, and wherein the male connection elements are received by the female connection elements when the coupler link is connected to the first bracket pin and the second bracket pin to form the fluid flow path.

13. The quick coupler system of claim 11, wherein the coupler link comprises a coupler lock member movably mounted on the coupler link body to move between an extended position wherein the coupler lock member engages to the second bracket pin to retain the second bracket pin within the second coupler pin opening and a retracted position wherein the coupler lock member does not engage the second bracket pin.

14. The quick coupler system of claim 11, wherein each of the first adapter side wall and the second adapter side wall comprises a pin opening inner surface defining a first portion of the first adapter pin opening, the adapter bracket comprising:

a first pin retention bracket defining a second portion of the first adapter pin opening of the first adapter side wall, wherein the first pin retention bracket connects to the first adapter side wall proximate the pin opening inner surface when the first bracket pin is disposed in the first portion to retain the first bracket pin in the first adapter pin opening of the first adapter side wall; and a second pin retention bracket defining a second portion of the first adapter pin opening of the second adapter side wall, wherein the second pin retention bracket connects to the second adapter side wall proximate the pin opening inner surface when the first bracket pin is disposed in the first portion to retain the first bracket pin in the first adapter pin opening of the second adapter side wall.

15. The quick coupler system of claim 14, wherein the pin opening inner surface of each of the first adapter side wall and the second adapter side wall comprises:

an inward portion having a first radius; and an outward portion having a second radius that is greater than the first radius.

16. An adapter bracket of a quick coupler system for connecting a work tool to an arm of a work machine, wherein the work tool includes a work tool bracket having a first bracket pin and a second bracket pin extending between a first bracket side plate and a second bracket side plate, the adapter bracket comprising:

a first adapter side wall;

a second adapter side wall spaced apart from the first adapter side wall to define an interior space that receives a coupler link of the quick coupler system when the quick coupler system connects the work tool to the arm of the work machine, wherein the first adapter side wall and the second adapter side wall each have a first pin opening inner surface defining a first portion of a first adapter pin opening that receives the first bracket pin therein and a second pin opening inner surface defining a second adapter pin opening that receives the second bracket pin therein, the second adapter pin opening of each of the first adapter side wall and the second adapter side wall has an opening gap at a bottom edge of the corresponding one of the first adapter side wall and the second adapter side wall;

a first pin retention bracket defining a second portion of the first adapter pin opening of the first adapter side wall, wherein the first pin retention bracket connects to the first adapter side wall proximate the first pin opening inner surface when the first bracket pin is disposed in the first portion of the first adapter pin opening to retain the first bracket pin in the first adapter pin opening of the first adapter side wall; and a second pin retention bracket defining a second portion of the first adapter pin opening of the second adapter side wall, wherein the second pin retention bracket connects to the second adapter side wall proximate the second pin opening inner surface when the first bracket pin is disposed in the first portion of the first adapter pin opening to retain the first bracket pin in the first adapter pin opening of the second adapter side wall, wherein the adapter bracket is attached to the work tool with the first bracket pin disposed within the first adapter pin opening of each of the first adapter side wall and the second adapter side wall, the second bracket pin passing through the opening gap and disposed within the second adapter pin opening of each of the first adapter side wall and the second adapter side wall, and the adapter bracket disposed between the first bracket side plate and the second bracket side plate.

17. The adapter bracket of claim 16, wherein the first pin opening inner surface of each of the first adapter side wall and the second adapter side wall comprises:

an inward portion having a first radius; and an outward portion having a second radius that is greater than the first radius.

18. The adapter bracket of claim 16, comprising a gap cover plate removably attached to the bottom edge of the first adapter side wall and the bottom edge of the second adapter side wall and extending across the opening gap of each of the first adapter side wall and the second adapter side wall to retain the second bracket pin within the second adapter pin opening of each of the first adapter side wall and the second adapter side wall.

19. The adapter bracket of claim 18, comprising a pin retention finger slidably mounted to the gap cover plate and slidable between a disengaged position wherein the pin retention finger is disengaged from the second bracket pin and an engaged position wherein the pin retention finger engages the second bracket pin to hold the second bracket pin against an inner surface of the second adapter pin opening of each of the first adapter side wall and the second adapter side wall to prevent movement of the first adapter side wall and the second adapter side wall relative to the second bracket pin in a radial direction.

20. The adapter bracket of claim 16, comprising an adapter hydraulic interface block mounted between the first adapter side wall and the second adapter side wall and positioned to align with a coupler hydraulic interface block of the coupler link so that the adapter hydraulic interface block and the coupler hydraulic interface block engage to form a fluid flow path for a flow of hydraulic fluid from arm hydraulic hoses supplying pressurized hydraulic fluid to work tool hydraulic hoses connected to the adapter hydraulic interface block.

* * * * *